US009395154B1

(12) United States Patent
Barnett

(10) Patent No.: US 9,395,154 B1
(45) Date of Patent: Jul. 19, 2016

(54) WEAPON STABILIZING DEVICE AND METHOD

(71) Applicant: Barnett Outdoors, LLC, Tarpon Springs, FL (US)

(72) Inventor: David A. Barnett, Tarpon Springs, FL (US)

(73) Assignee: Barnett Outdoors, LLC, Tarpon Springs, FL (US)

( * ) Notice: Subject to any disclaimer, the term of this patent is extended or adjusted under 35 U.S.C. 154(b) by 0 days.

(21) Appl. No.: 14/591,190

(22) Filed: Jan. 7, 2015

(51) Int. Cl.

| | |
|---|---|
| ***F41C 27/00*** | (2006.01) |
| ***F41C 27/22*** | (2006.01) |
| ***F41A 35/00*** | (2006.01) |
| ***F41C 23/02*** | (2006.01) |
| ***F41C 33/00*** | (2006.01) |

(52) U.S. Cl.
CPC ..... *F41C 27/00* (2013.01); *F41C 23/02* (2013.01); *F41C 27/22* (2013.01); *F41C 33/001* (2013.01)

(58) Field of Classification Search
CPC ..... F41C 23/02; F41C 27/22; F41C 33/001; F41C 33/002; F41C 33/08; F41A 35/00; F41A 99/00
USPC ..... 42/90, 994, 97; 224/150; 242/384.7
See application file for complete search history.

(56) References Cited

U.S. PATENT DOCUMENTS 1,069,623 A * 8/1913 Lutkens ..... F41C 23/02 24/265 AL
1,115,737 A * 11/1914 Prochnow ..... F41C 23/02 242/384.7
1,177,748 A * 4/1916 Webster ..... F41A 21/08 42/106
2,614,355 A * 10/1952 Rogers ..... F41C 23/02 224/150
5,009,022 A * 4/1991 McCoy ..... F41C 33/001 42/106
5,173,067 A * 12/1992 Biba ..... B63C 11/26 242/156
5,513,785 A * 5/1996 Campagna, Jr. ..... F41C 33/04 224/162
6,752,369 B1 6/2004 Cameron
6,904,872 B2 * 6/2005 Muller ..... B65H 75/4431 119/789
7,246,811 B2 7/2007 Martin
7,458,488 B2 12/2008 Bass et al.
7,677,233 B2 3/2010 Bednar
7,743,544 B2 6/2010 Laney et al.
7,930,851 B1 * 4/2011 Woolsey ..... F41C 33/002 224/150

(Continued)

OTHER PUBLICATIONS

U.S. Appl. No. 29/513,881, "Stabilizing Device," David A. Barnett, filed Jan. 6, 2015.

(Continued)

*Primary Examiner* — Bret Hayes
(74) *Attorney, Agent, or Firm* — Jones Walker LLP

(57) ABSTRACT

A weapon stabilizing device for stabilizing a weapon during use. The device includes a spool member configured to release and retract an anchor line with rotation of the spool member. A lock member prevents rotation of the spool member in a locked position and allows rotation of the spool member in a released position. Actuation of an activation member switches the lock member from a default position to an activated position. The default position may be the locked position or the released position. When the default position is the locked position, the activated position is the released position. When the default position is the released position, the activated position is the locked position. A spool spring may provide continuous positive rotation of the spool member in the released position. The weapon stabilizing device may be connected to or within a base of a weapon.

30 Claims, 21 Drawing Sheets

(56) References Cited

U.S. PATENT DOCUMENTS

2004/0083637 A1* 5/2004 Sands ..... F41C 33/001 42/85
2005/0091902 A1 5/2005 Sands
2006/0131457 A1* 6/2006 Nohren et al. ..... B60R 22/14 242/384.7
2006/0266300 A1 11/2006 Perkitny
2007/0151999 A1* 7/2007 Thompson ..... F41C 33/001 224/150
2011/0151941 A1* 6/2011 Chan ..... B65H 75/4431 455/569.1
2011/0179688 A1 7/2011 Ash et al.

OTHER PUBLICATIONS

U.S. Appl. No. 29/513,998, "Stabilizing Device," David A. Barnett, filed Jan. 7, 2015.
International Search Report and Written Opinion of the International Searching Authority in applicant's counterpart International Patent Application No. PCT/US2016112277.

* cited by examiner

WEAPON STABILIZING DEVICE AND METHOD

DETAILED DESCRIPTION OF THE PREFERRED EMBODIMENTS

Figure 1:
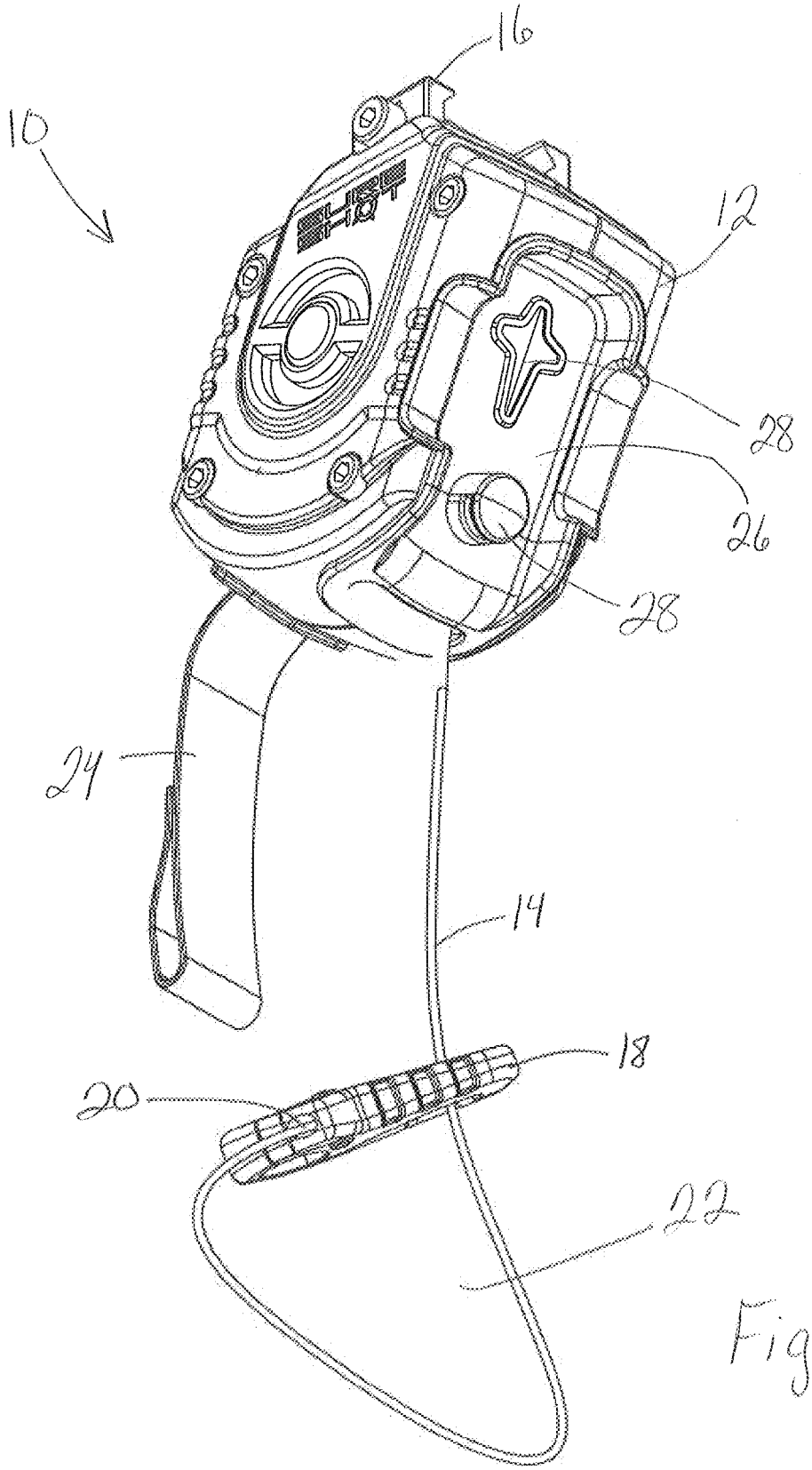
FIG. 1 is a perspective view of a stabilizing device.
Figure 2:
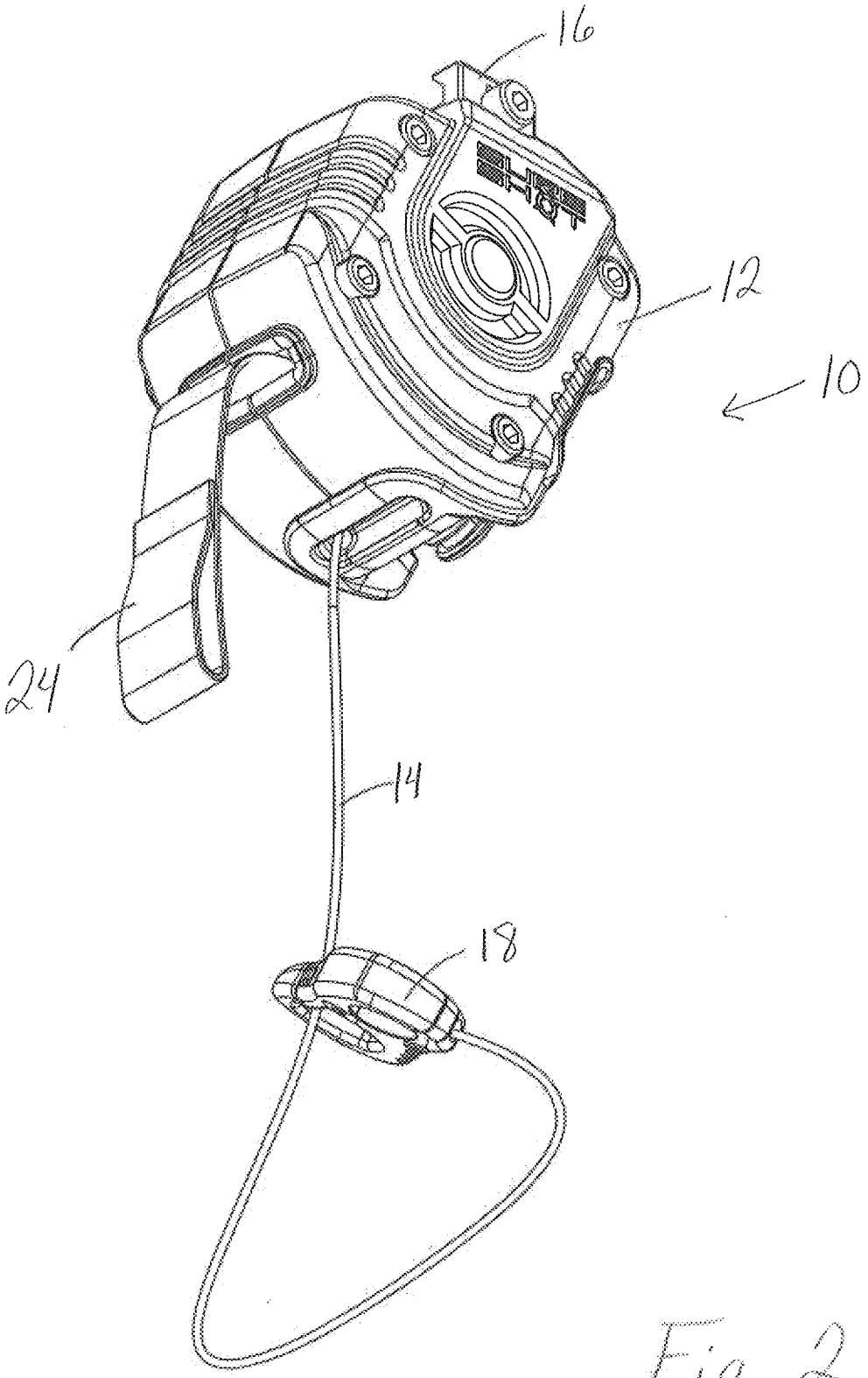
FIG. 2 is another perspective view of the stabilizing device.
Figure 3:
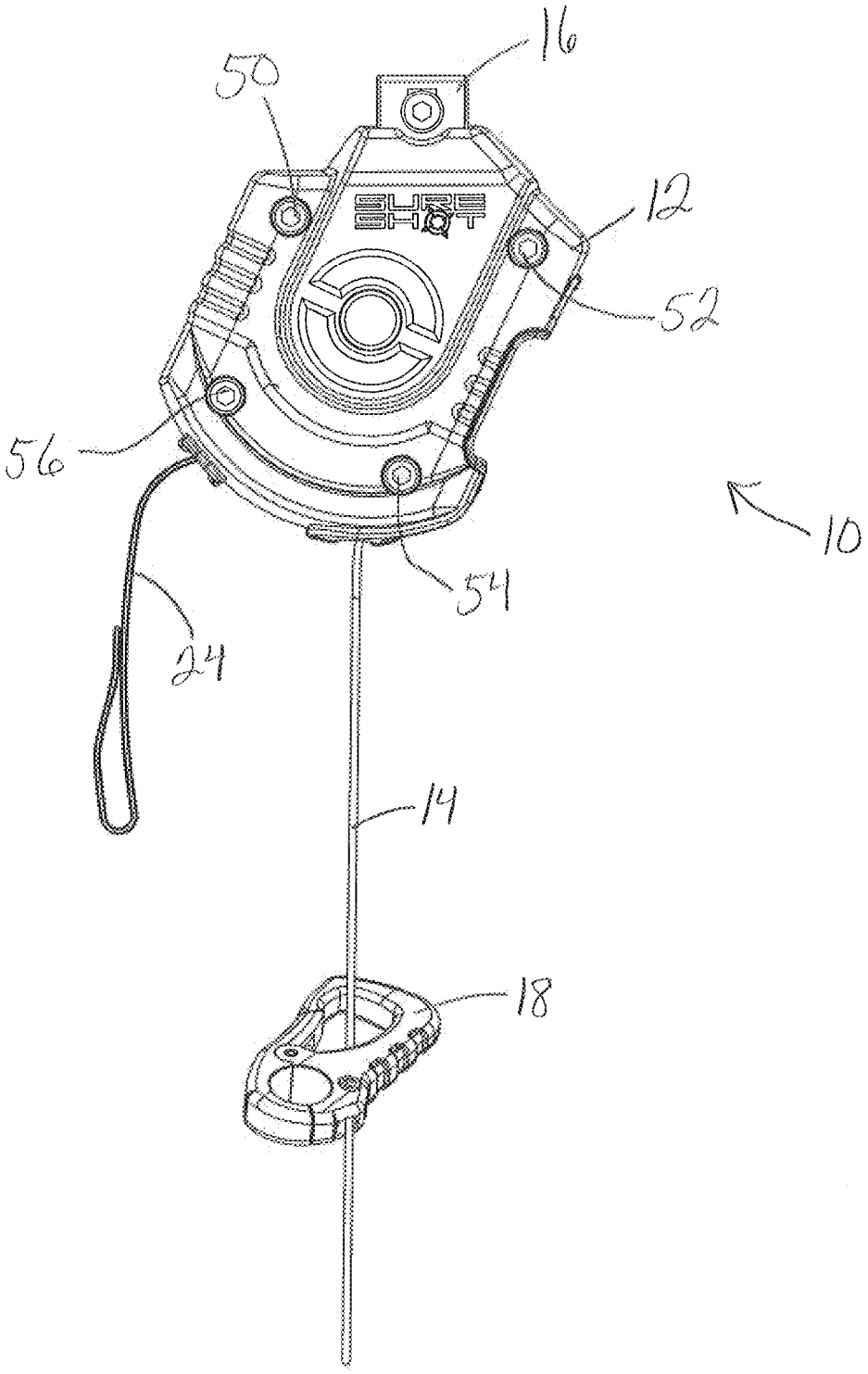
FIG. 3 is a side view of the stabilizing device.

FIGS. 1-3 illustrate weapon stabilizing device 10. Stabilizing device 10 includes housing 12, anchor line 14, and attachment mechanism 16. Stabilizing device 10 may be configured to allow release or retraction of anchor line 14. Housing 12 may be formed of a metal, a plastic, or another polymer. Anchor line 14 may be formed of any linear object (e.g., a string, a cord, or a cable) of any durable material (e.g., a nylon, a polymer, or a metal). In one embodiment, anchor line 14 may be formed of a steel cable covered with a polymer coating, which is commercially available from Loos and Co. Attachment mechanism 16 may be configured to connect housing 12 to a base of a weapon, which will be described in more detail below. Anchor attachment member 18 may be operatively connected to distal end 20 of anchor line 14. Anchor attachment member 18 may be formed of any object capable of securing distal end 20 of anchor line 14 to another object to provide tension in anchor line 14 between housing 12 and the other object. For example, anchor attachment member 18 may be formed of a carabiner clip (shown in FIGS. 1-3), which may be attached to another object or may be attached to anchor line 14 to form loop 22 of anchor line 14.

Stabilizing device 10 may include activation member 24. Actuation of activation member 24 may switch stabilizing device 10 from a default position into an activated position. In one embodiment, the default position of stabilizing device 10 may prevent release or retraction of anchor line 14, but actuation of activation member 24 may allow anchor line 14 to be released from or retracted into housing 12 (i.e., the activated position). In another embodiment, the default position of stabilizing device 10 may allow anchor line 14 to be released from or retracted into housing 12, but actuation of activation member 24 may prevent release or retraction of anchor line 14 (i.e., the activated position). Anchor line 14 and activation member 24 may each be partially disposed within housing 12. Activation member 24 may be formed of a flexible strap, a rigid member, a button mechanism, or any other item capable of switching stabilizing device 10 from the default position into the activated position.

Figure 4:
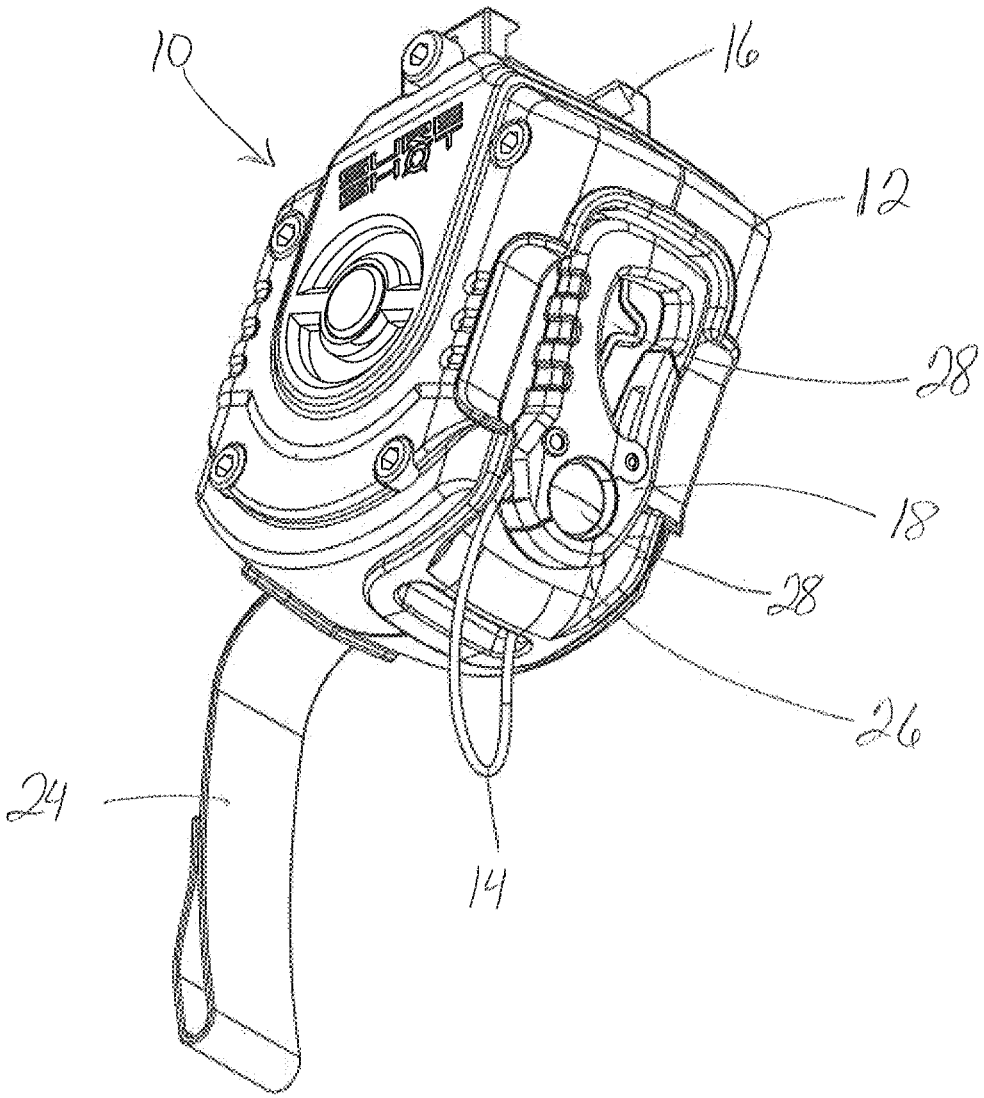
FIG. 4 is a perspective view of the stabilizing device with an anchor attachment member secured to a housing of the stabilizing device.

With reference to FIGS. 1 and 4, housing 12 may include recess 26 having one or more protrusions 28. Protrusions 28 may be dimensioned and shaped to fit within openings of anchor attachment member 18 in order to secure anchor attachment member 18 within recess 26 of housing 12 as shown in FIG. 4. In this way anchor attachment member 18 may be stored when stabilizing device 10 is not in use.

Figure 5:
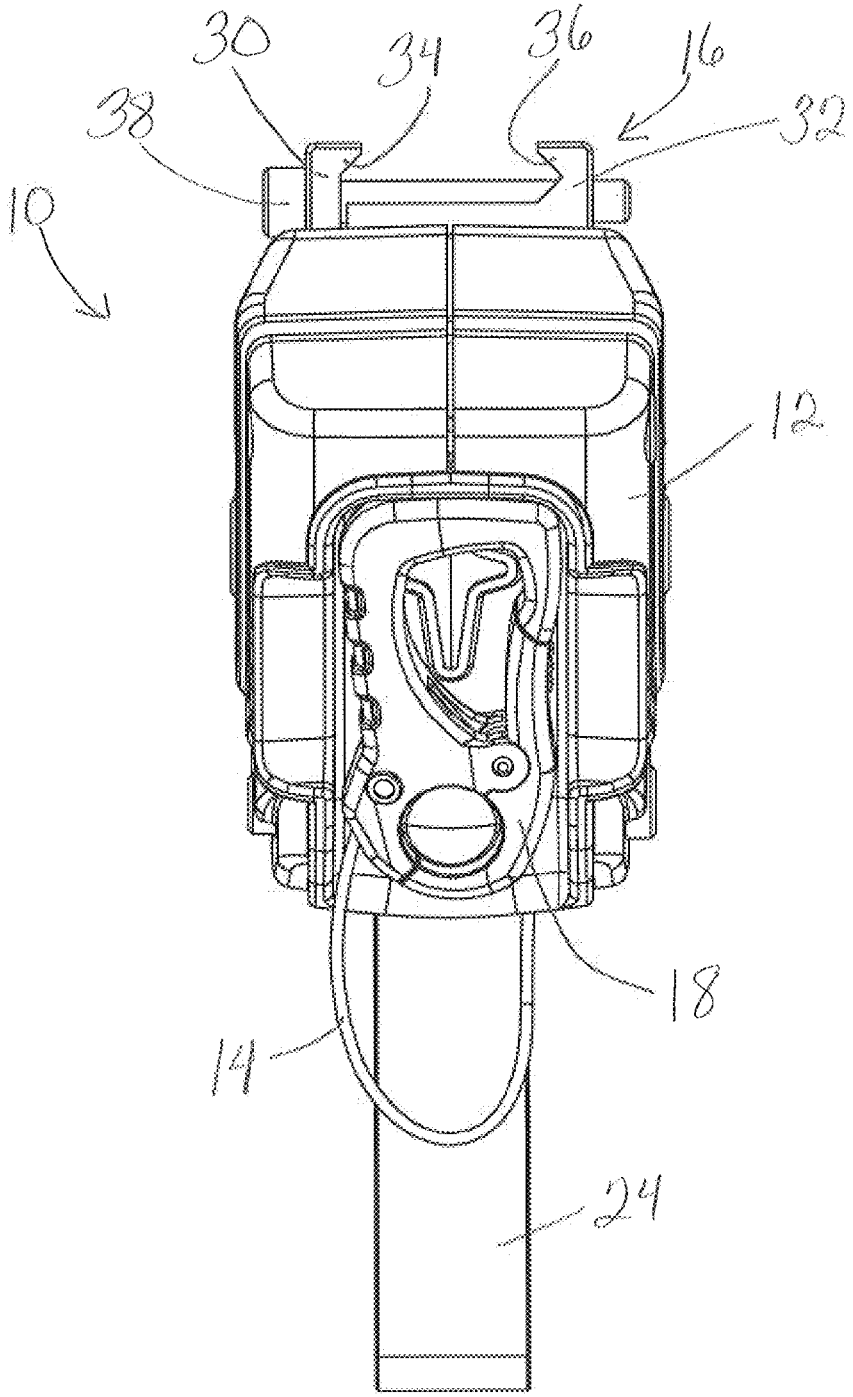
FIG. 5 is a front view of the stabilizing device with the anchor attachment member secured to the housing.

Referring now to FIG. 5, attachment mechanism 16 may be formed of a Picatinny rail. Side members 30 and 32 may each include tapered upper shoulder 34 and 36, respectively. Bolt 38 may be disposed through an aperture in each of side members 30 and 32.

Figure 6:
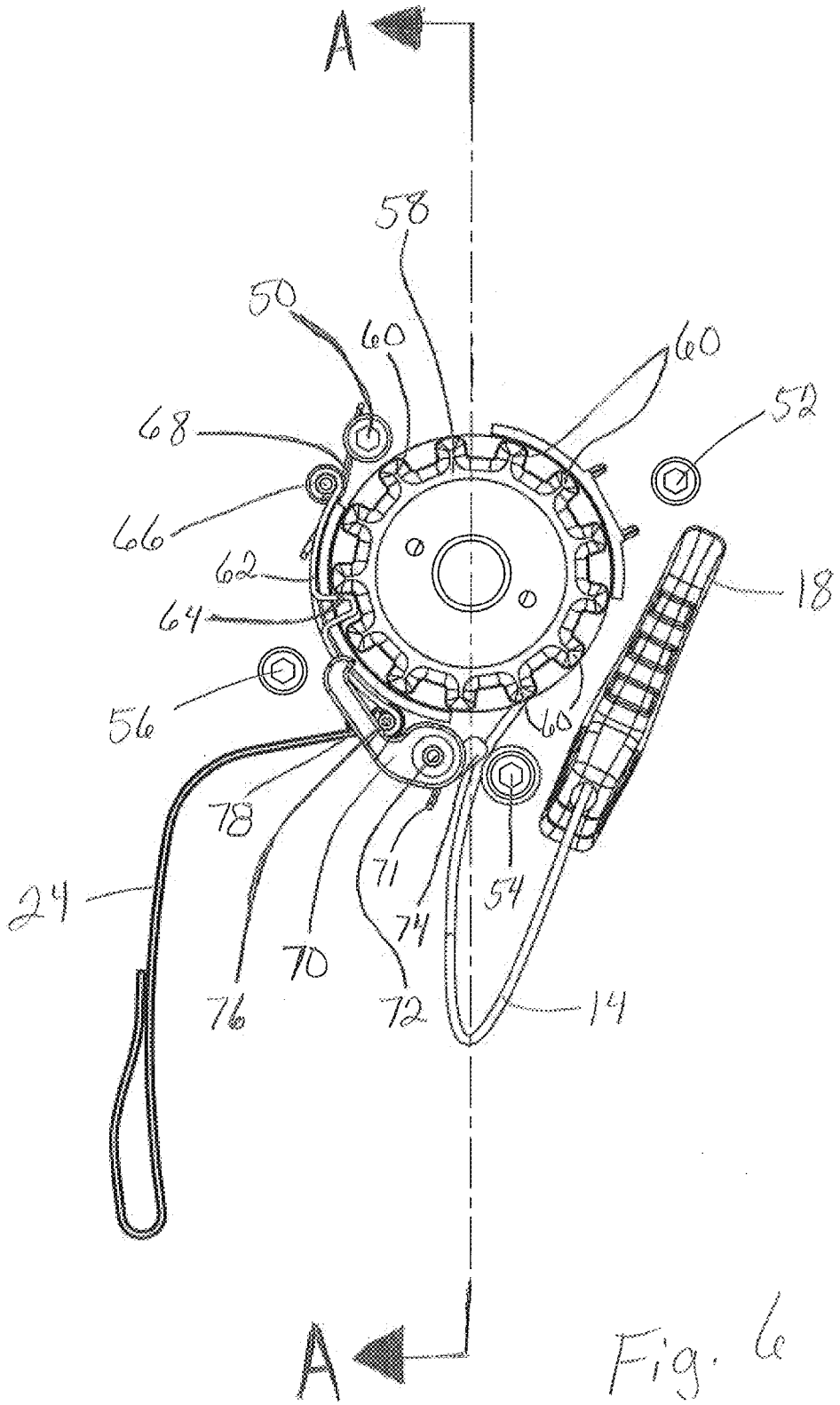
FIG. 6 is an internal side view of the stabilizing device.

FIG. 6 illustrates one embodiment of stabilizing device 10 without housing 12, i.e., an internal view. Pin members 50, 52, 54, and 56 may be used to secure housing 12 onto the internal assembly. Gear 58 may include a plurality of gear teeth 60 around its circumference. Lock member 62 may be disposed along the circumference of gear 58. Lock member 62 may include lock protrusion 64 configured to engage gear teeth 60. A proximate end of lock member 62 may be pivotally attached to lock axis member 66. Lock spring 68 may pivotally bias lock member 62 toward gear 58, in turn biasing lock protrusion 64 toward the plurality of gear teeth 60.

Guide member 70 may be operatively associated with lock member 62. Guide spring 71 disposed around guide axis member 72 may pivotally bias guide member 70 toward lock member 62 and gear 58. Guide member 70 may further include brake member 74. A distal end of lock member 62 may be pivotally attached to release axis member 76. Proximal end 78 of activation member 24 may also be attached to release axis member 76. Guide member 70 may engage release axis member 76 and, due to the pivotal bias provided by guide spring 71, guide member 70 may push release axis member 76 along with the distal end of lock member 62 toward gear 58. In this way, lock member 62 may lock gear 58 thereby preventing rotation of gear 58. In the embodiment of stabilizing device 10 shown in FIG. 6, lock spring 68 and guide spring 71 may set this locked position as the default position of stabilizing device 10. In the locked position, brake member 74 of guide member 70 may press anchor line 14 against pin member 54, thereby maintaining tension on anchor line 14 within housing 12.

Actuation of activation member 24 may switch stabilizing device 10 from a default position to an activated position. Where activation member 24 is a flexible strap, activation member 24 may be activated by pulling activation member 24 away from gear 58. Actuation of activation member 24 will transfer release axis member 76 along with distal end of lock member 62 away from gear 58, which in turn may disengage lock protrusion 64 from gear teeth 60 allowing rotation of gear 58. With this movement of release axis member 76, guide member 70 may be pivoted away from gear 58. In this way, actuation of activation member 24 may switch stabilizing device 10 from the default locked position to the activated position, which is a released position. In the released position, gear 58 may rotate allowing release or retraction of anchor line 14. In this position, brake member 74 of guide member 70 may be rotated away from pin member 54 such that anchor line 14 may easily move through the space between brake member 74 and pin member 54. Upon terminating the actuation of activation member 24, the gear spring and guide member 70 may cause the release axis member 76 to move to its original position, thereby engaging gear teeth 60 with lock protrusion 64 (i.e., returning stabilizing device 10 to the default locked position). Where activation member 24 is a rigid member or a button mechanism, activation member 24 may be actuated by pushing, pressing, twisting, or simply touching activation member 24.

Figure 7:
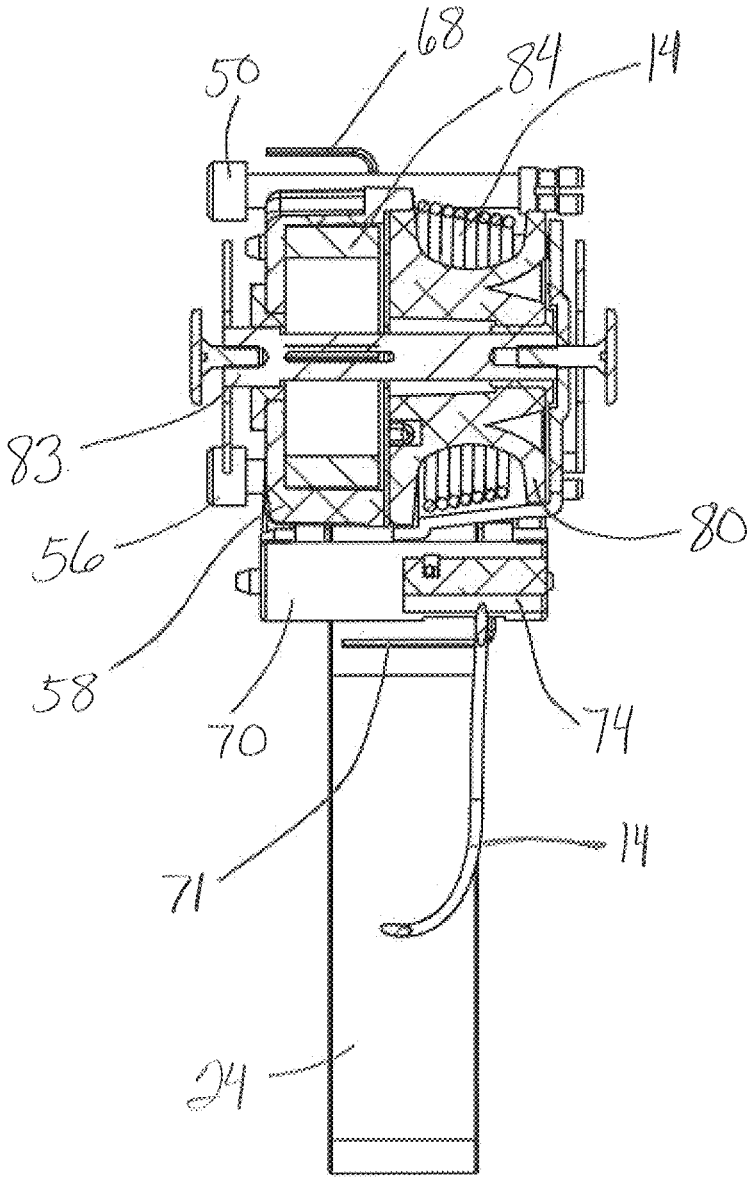
FIG. 7 is an internal cross-section of the stabilizing device taken from line A-A in FIG. 6.
Figure 8:
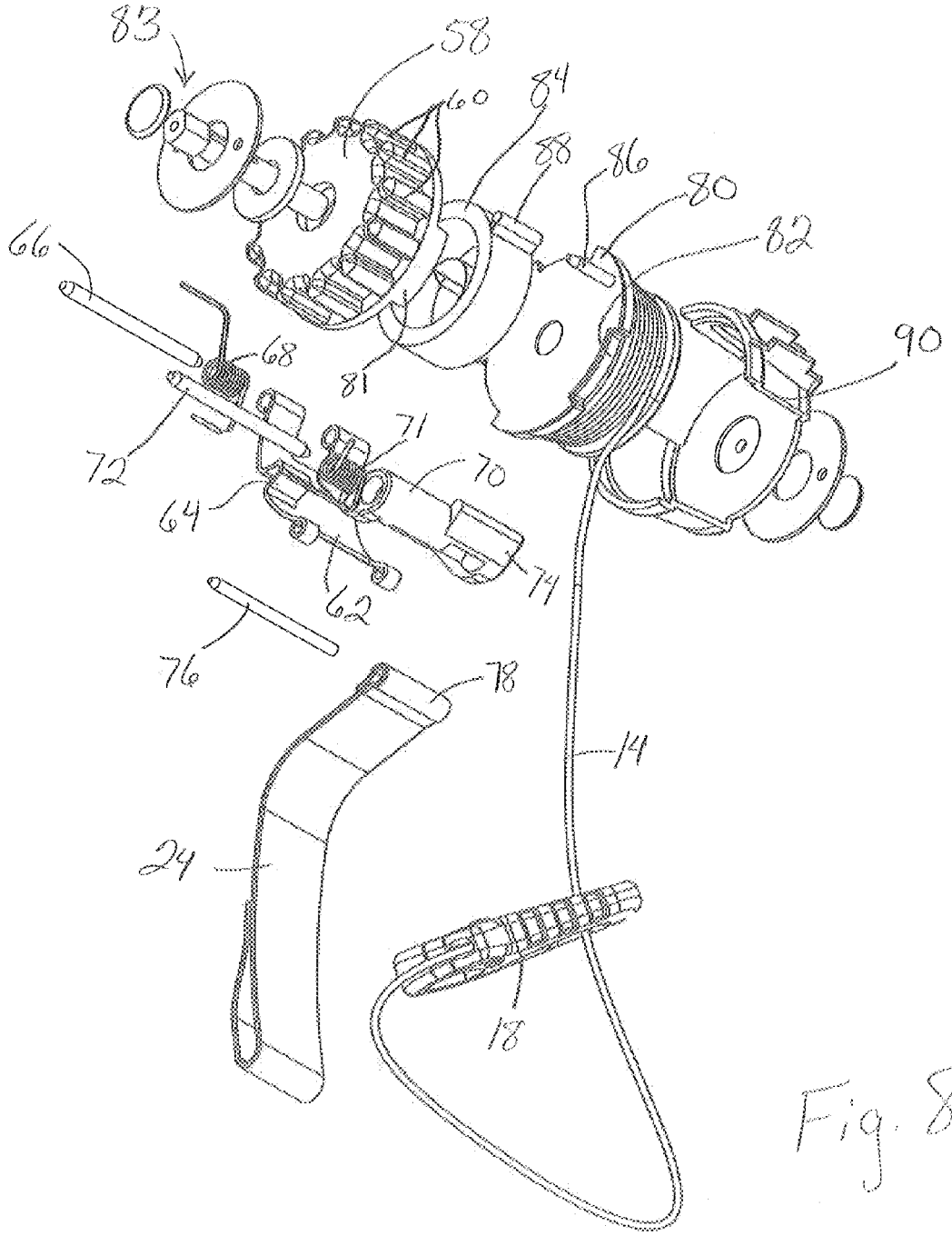
FIG. 8 is an internal exploded view of the stabilizing device.
Figure 9:
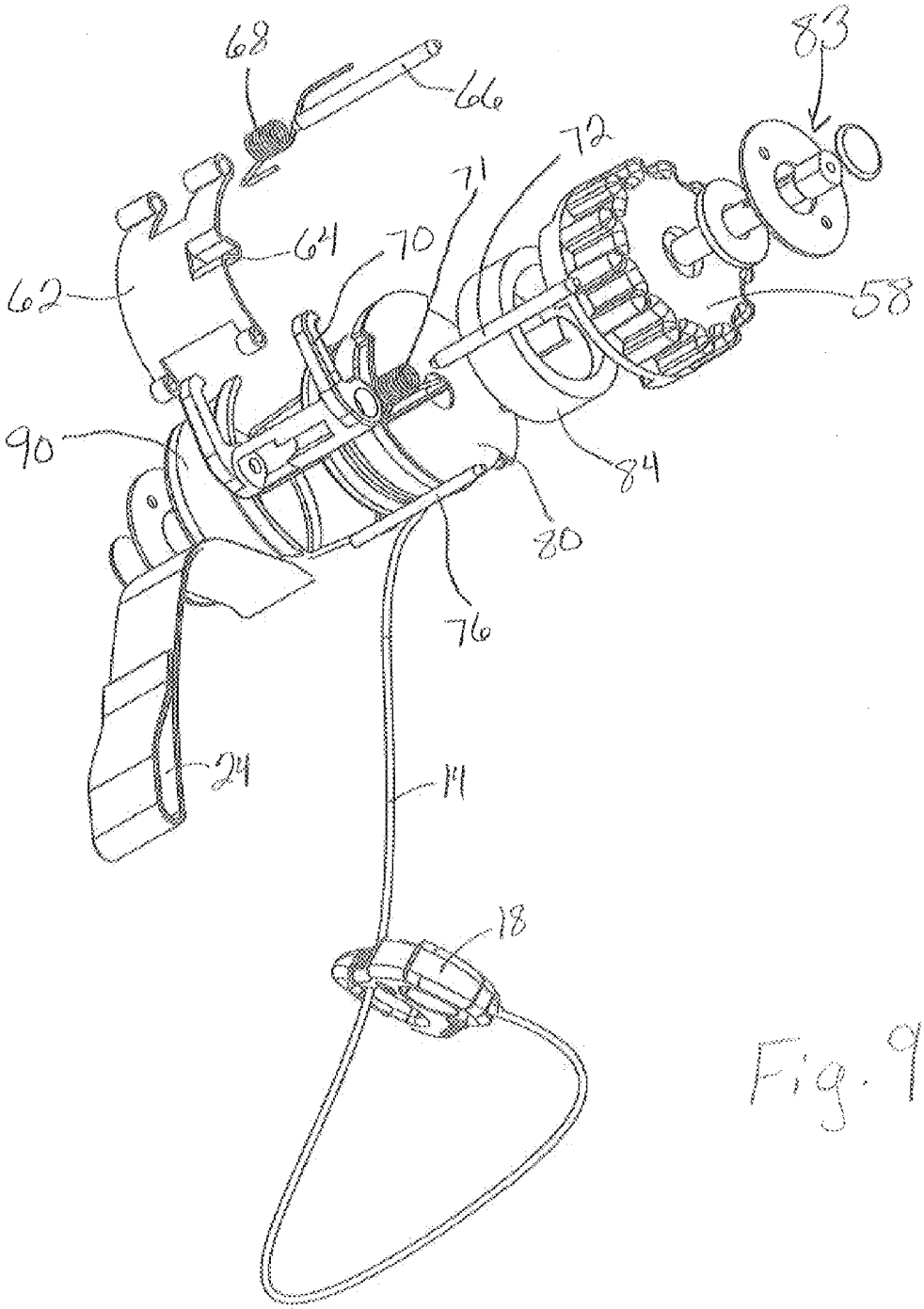
FIG. 9 is another internal exploded view of the stabilizing device.

With reference to FIGS. 7-9, stabilizing device 10 may further include spool 80 for housing anchor line 14. One or more extensions 81 of gear 58 may engage recesses 82 in the front face of spool 80 to rotationally lock spool 80 to gear 58. Accordingly, in the locked position, spool 80 may be prevented from rotating about central axis assembly 83. In the released position, spool 80 may be allowed to rotate in order to release or retract anchor line 14. Spool spring 84 may be operatively connected and rotationally locked to spool 80. For example, pin extension 86 of spool 80 may engage receptacle 88 of spool spring 84 such that rotation of spool spring 84 rotates spool 80. Spool spring 84 may provide positive rotation of spool 80 in the released position. In other words, spool spring 84 continuously retracts anchor line 14 in the released position, unless an opposite force is applied to distal end 20 of anchor line 14. Spool housing 90 may be disposed around spool 80 to maintain the position of anchor line 14 on spool 80. Each internal component of stabilizing device 10 may be formed of a metal, a polymer, or any other durable material.

Figure 10:
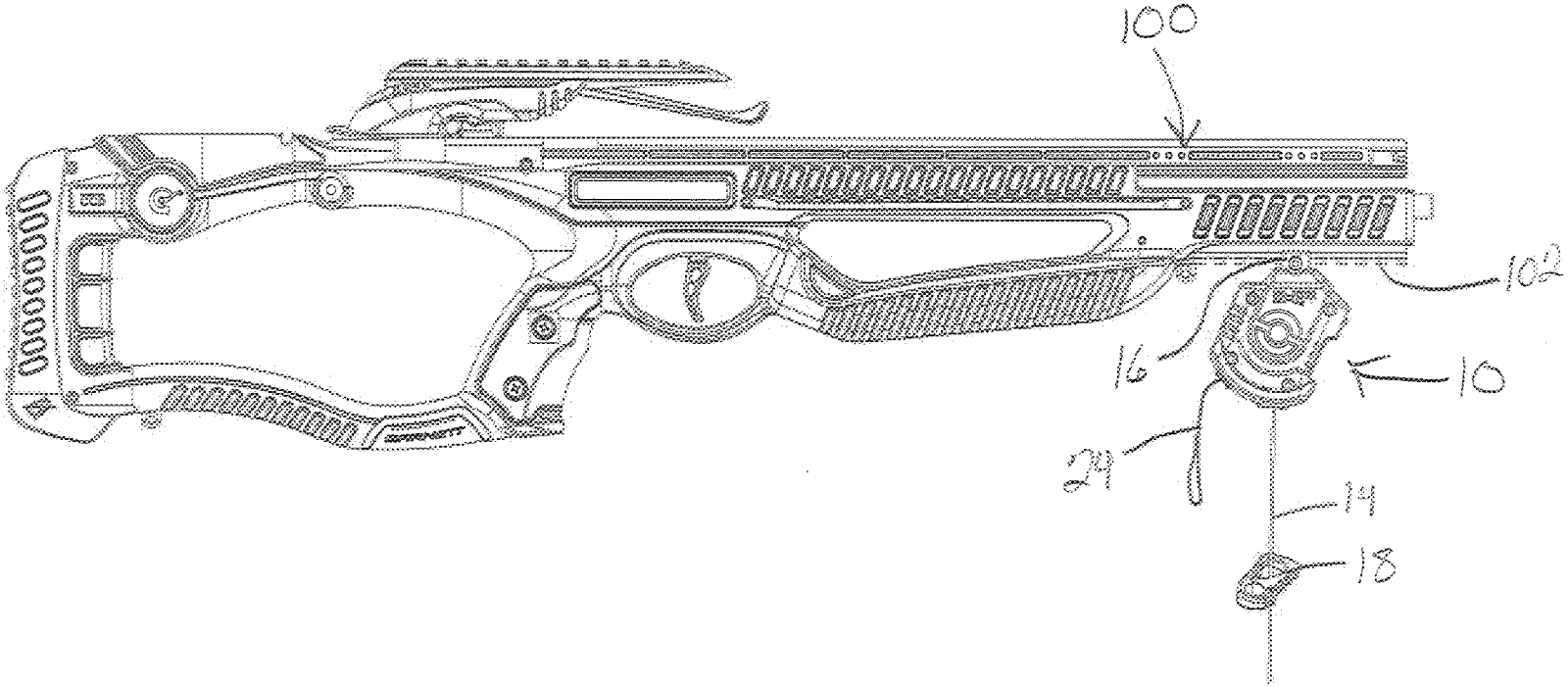
FIG. 10 is a side view of the stabilizing device attached to a crossbow stock.
Figure 11:
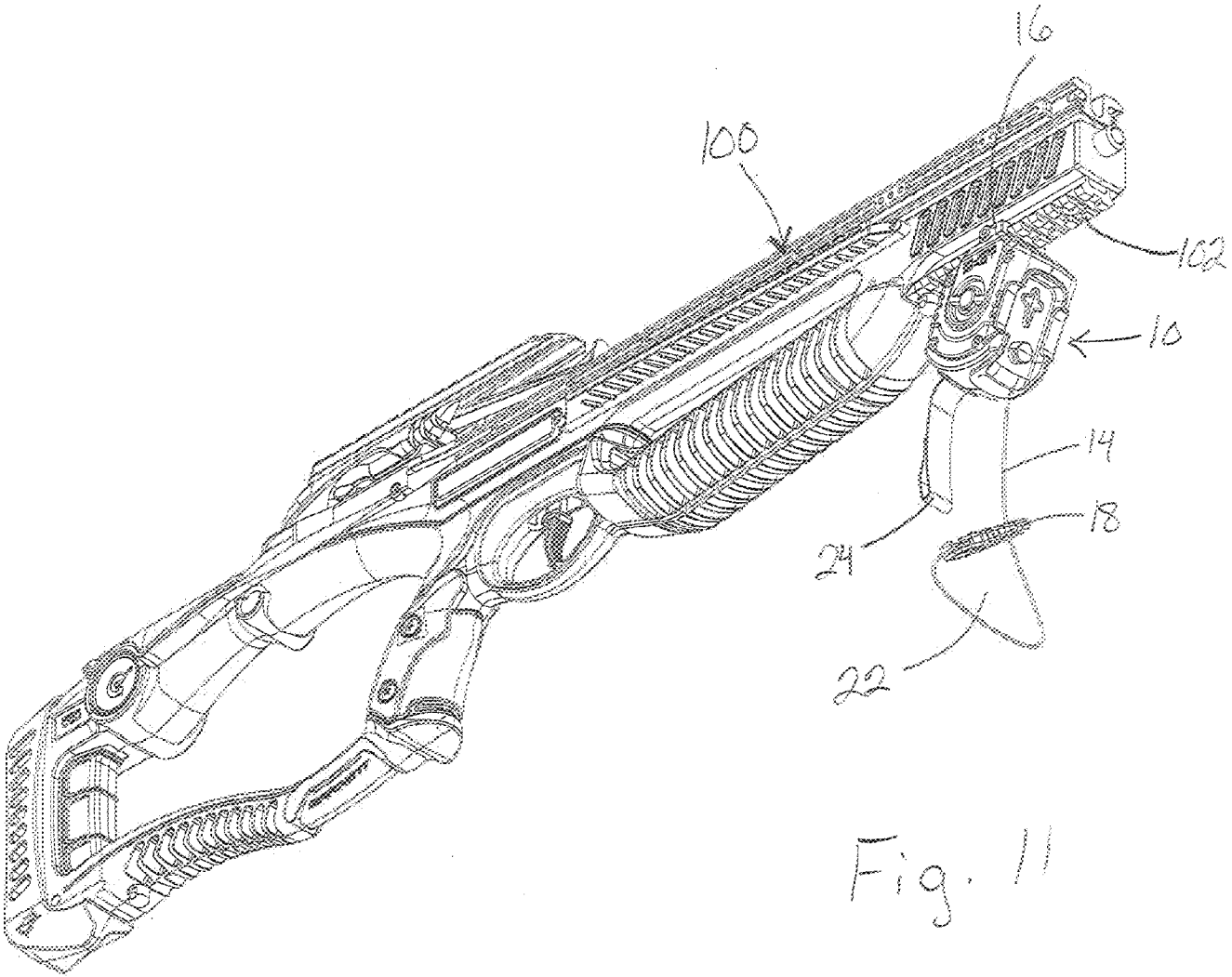
FIG. 11 is a perspective view of the stabilizing device attached to the crossbow stock.

Stabilizing device 10 may be attached to a base of a weapon for stabilizing the weapon during use. For example, attachment member 16 of stabilizing device 10 may be attached to the bottom of crossbow stock 100 shown in FIGS. 10 and 11. In this embodiment, side members 30, 32 of attachment member 16 may slide along Picatinny rail 102 of crossbow stock 100. The interaction of tapered upper shoulders 34, 36 of attachment member 16 with Picatinny rail 102 may secure stabilizing device 10 to crossbow stock 100. Once stabilizing device 10 is positioned at the desired location along Picatinny rail 102, bolt 38 may be inserted through the apertures of side members 30, 32 to lock stabilizing device 10 into place. In alternate embodiments, stabilizing device 10 may be attached to an archery bow, a rifle, a shotgun, or a pistol. In other embodiments, attachment member 16 may be formed of one or more bolts or screws that are secured to the base of the weapon.

Figure 12:
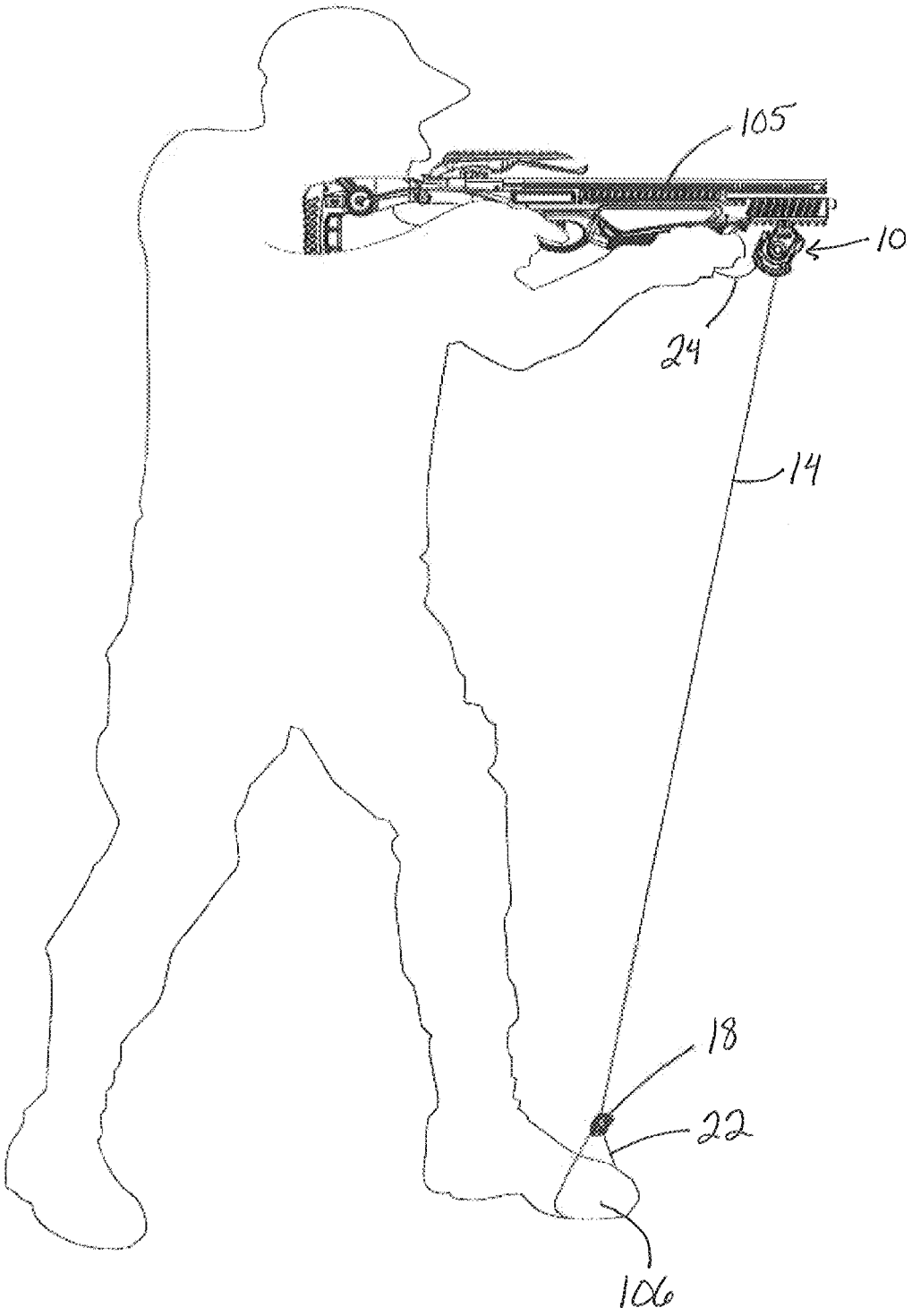
FIG. 12 is a schematic view of the stabilizing device in use.

Referring now to FIG. 12, with stabilizing device 10 attached to weapon 105, activation member 24 may be actuated to place stabilizing device 10 in the released position. Anchor line 14 may be pulled from housing 12 and anchor attachment member 18 may be secured to an anchor object, such as the user's foot 106. Other suitable anchor objects include, but are not limited to, a user's belt, a portion of a tree, or a treestand. It should be understood that any stable object may be used as the anchor object. In one embodiment, anchor attachment member 18 may be secured to another portion of anchor line 14 in order to form loop 22. Loop 22 may be placed around the user's foot 106 for stabilizing weapon 105 while firing weapon 105.

Once anchor attachment member 18 is secured to a suitable anchor object, activation member 24 may be released to return stabilizing device 10 to the locked position. The user may fire the weapon with stabilizing device 10 secured thereto as described. Stabilizing device 10 may provide additional stability to the front end of the weapon during use to increase the user's precision.

Figure 13:
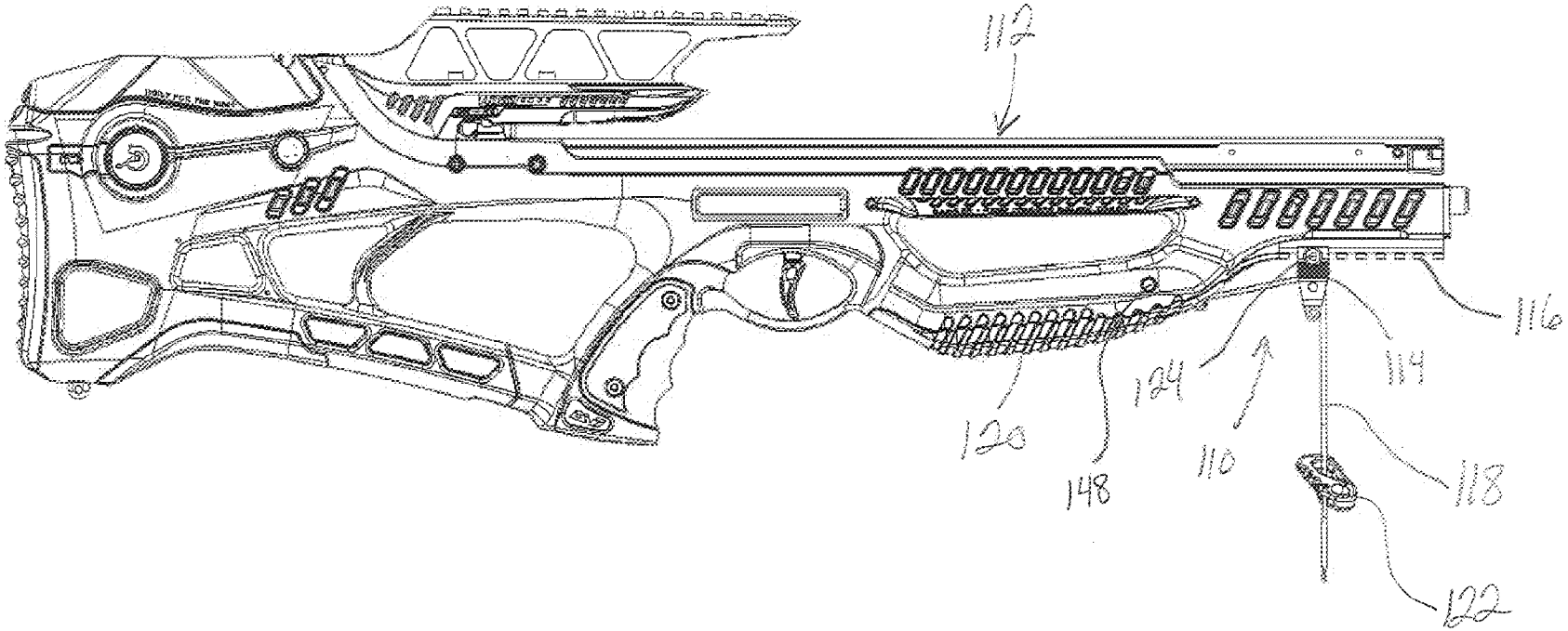
FIG. 13 is a side view of an alternate embodiment of the stabilizing device connected to a crossbow stock.
Figure 14:
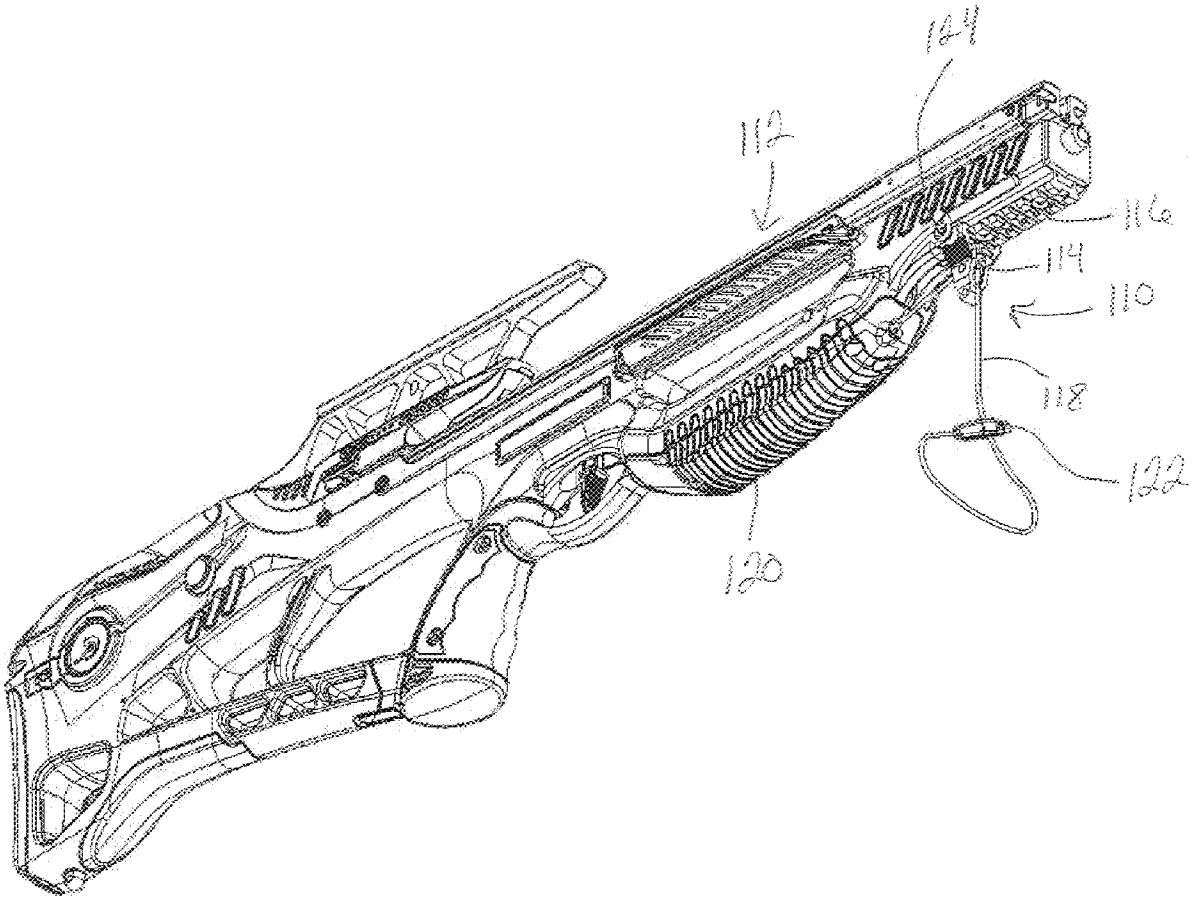
FIG. 14 is a perspective view of the stabilizing device of FIG. 13 connected to the crossbow stock.
Figure 15:
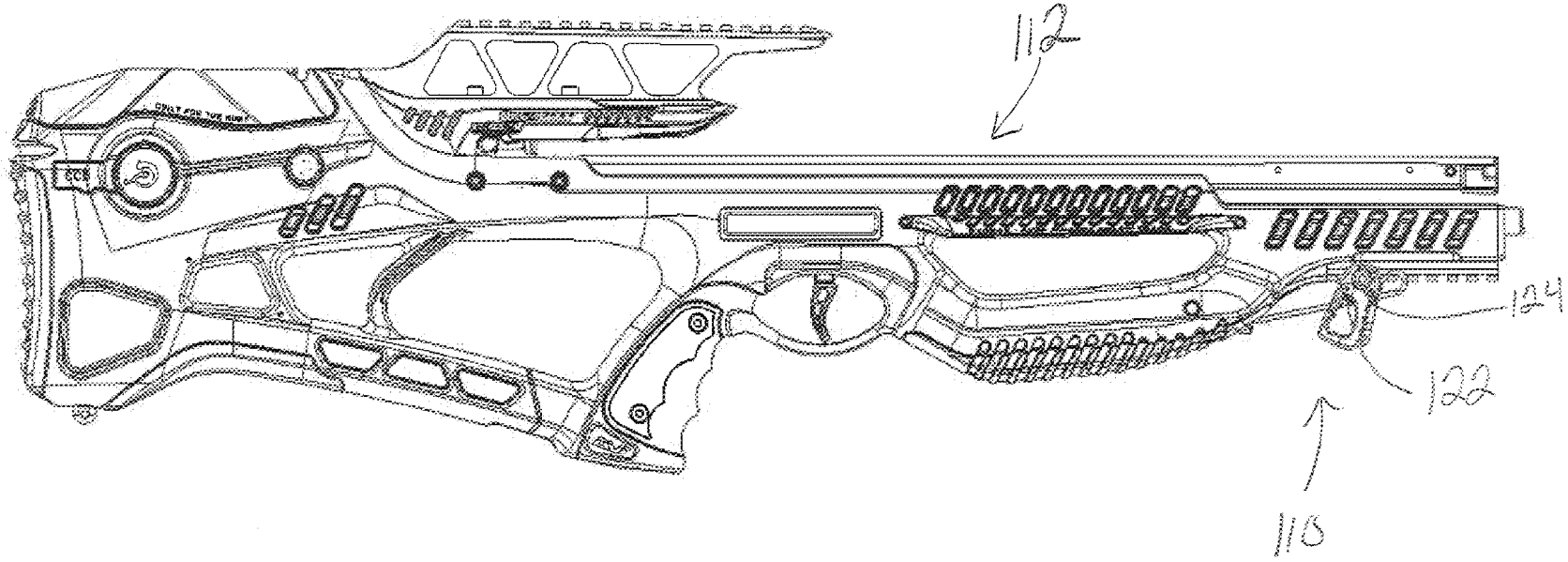
FIG. 15 is a side view of the stabilizing device of FIG. 13 connected to a crossbow stock with an anchor attachment member secured to the stabilizing device.

FIGS. 13 and 14 illustrate stabilizing device 110 connected to crossbow stock 112. Stabilizing device 110 may include positioning member 114 connected to Picatinny rail 116 of crossbow stock 112. Stabilizing device 110 may be configured to retract and release anchor line 118 from within foregrip 120 of crossbow stock 112. Anchor attachment member 122 may be connected to a distal end of anchor line 118. As shown in FIG. 15, anchor attachment member 122 may be secured to peg 124 on positioning member 114.

Figure 16:
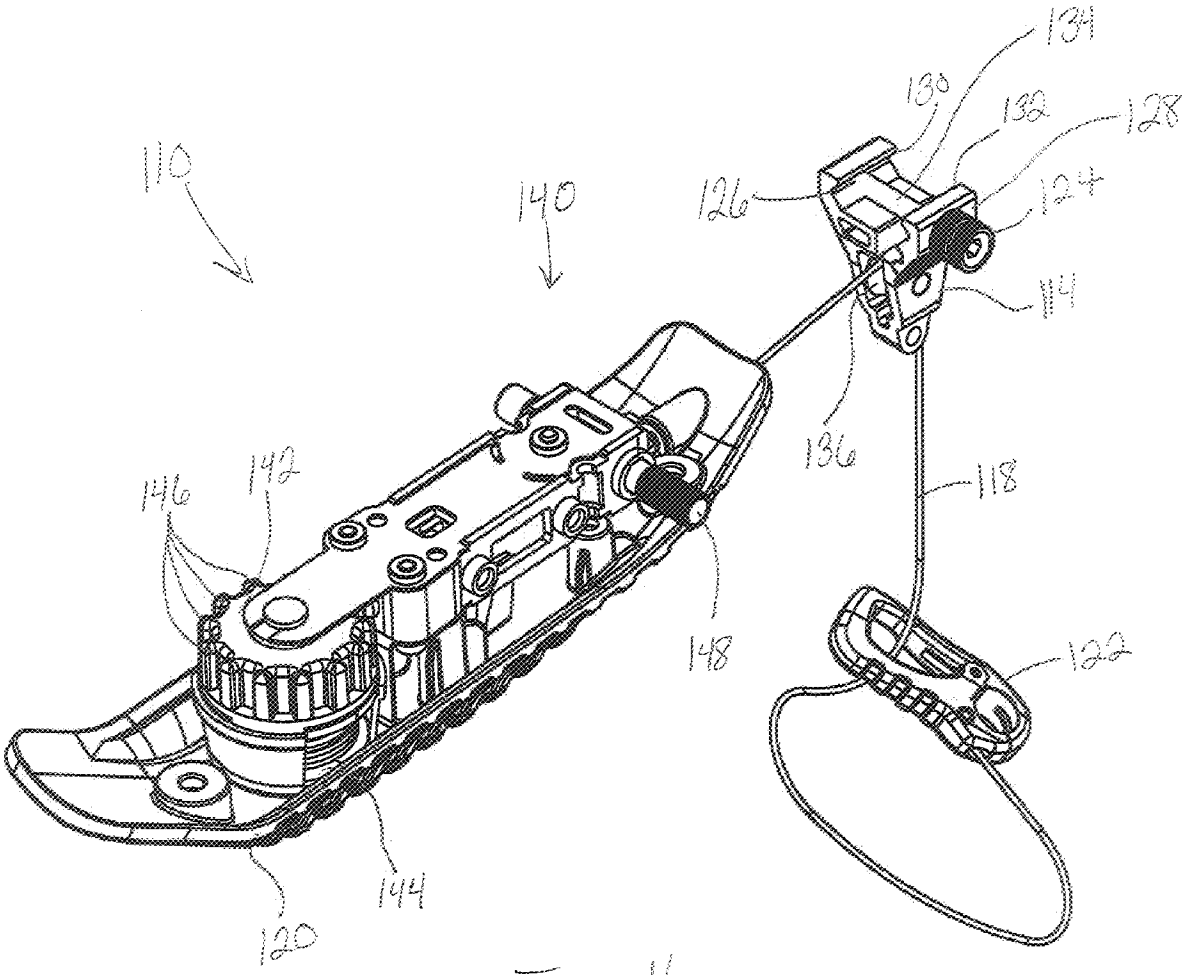
FIG. 16 is a perspective view of the stabilizing device of FIG. 13 connected to a foregrip shell of a crossbow stock.

With reference to FIG. 16, positioning member 114 of stabilizing device 110 may be formed of a Picatinny rail. Side member 126 and 128 may each include tapered upper shoulder 130 and 132, respectively. Bolt 134 may be disposed through an aperture in each of side members 126 and 128. In one embodiment, peg 124 is formed of an end of bolt 134. Positioning member 114 may also include an aperture to receive anchor line 118. As anchor line 118 slides through the aperture of positioning member 114, anchor line 118 may slide over guide surface 136, which may have a concave surface for accommodating the shape of anchor line 118.

Figure 17:
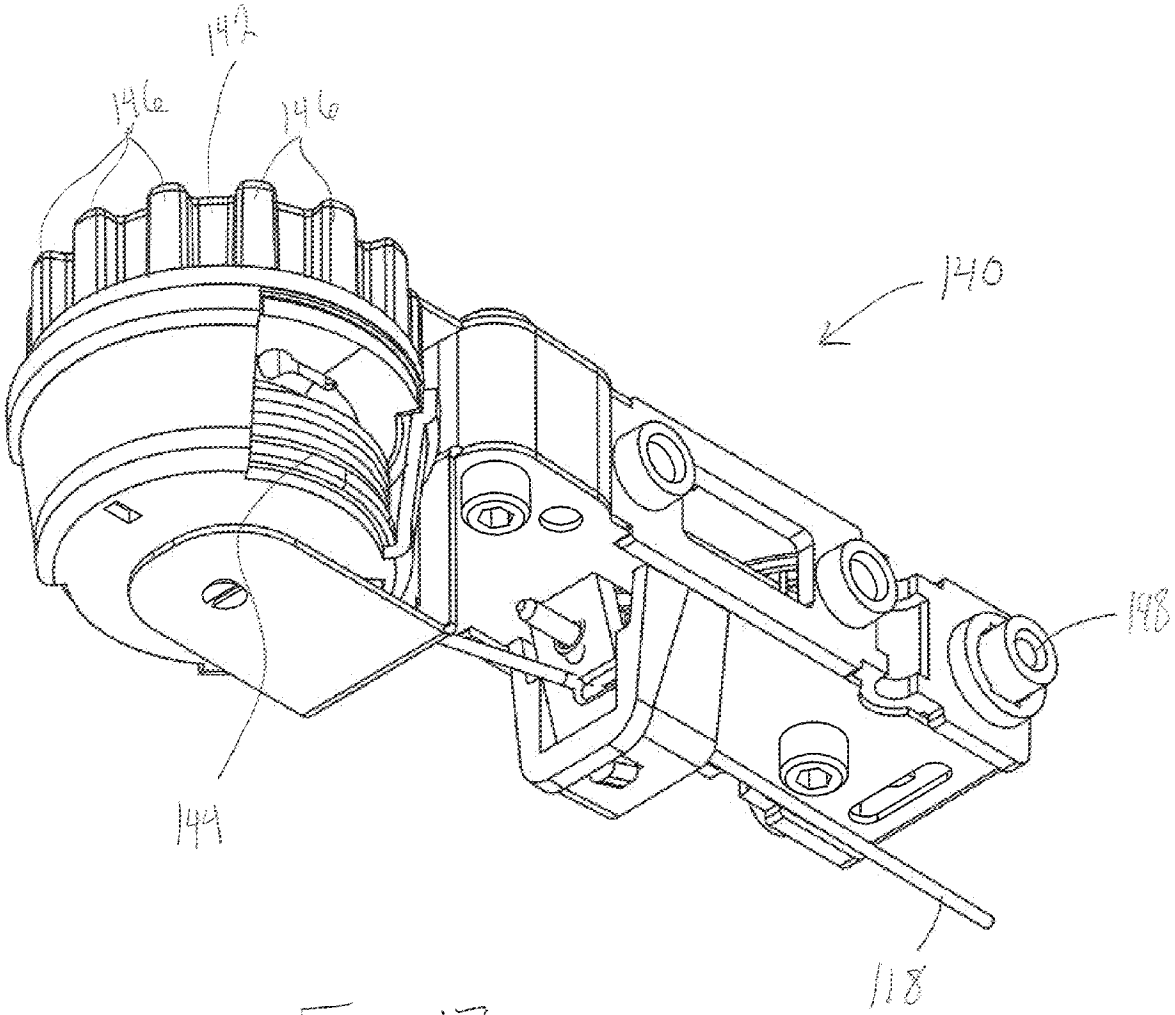
FIG. 17 is a perspective view of the stabilizing device of FIG. 13.
Figure 18:
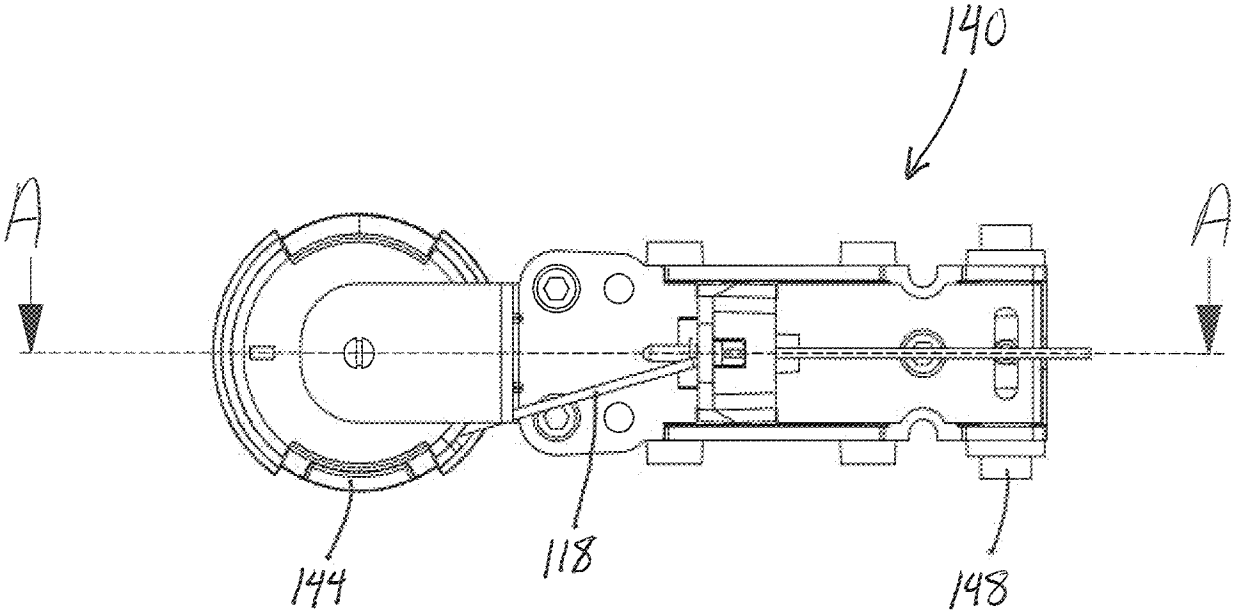
FIG. 18 is a bottom view of the stabilizing device of FIG. 13.

Referring now to FIGS. 16-18, stabilizing device 110 may include internal portion 140 connected within foregrip 120 of crossbow stock 112. In other words, foregrip 120 may form a housing of stabilizing device 110. Internal portion 140 may include gear 142 and spool 144. Gear 142 may include a plurality of gear teeth 146. Anchor line 118 may be wrapped around spool 144 for storage. Activation member 148 may be configured to switch stabilizing device 110 from a default position to an activated position. In this embodiment, activation member 148 may be formed of a rigid button mechanism.

Figure 19:
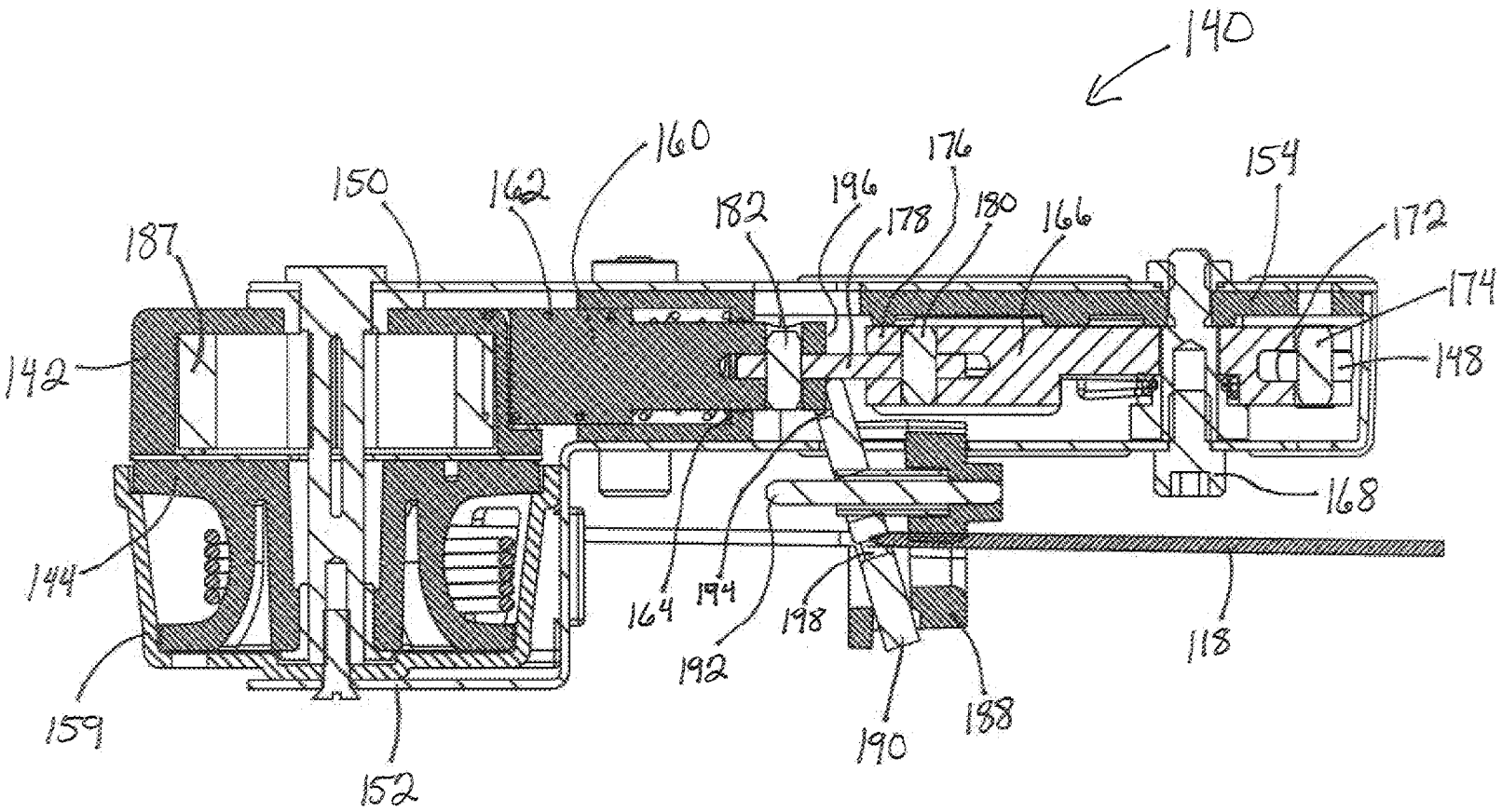
FIG. 19 is a cross-sectional view of the stabilizing device taken along line A-A in FIG. 18.
Figure 20:
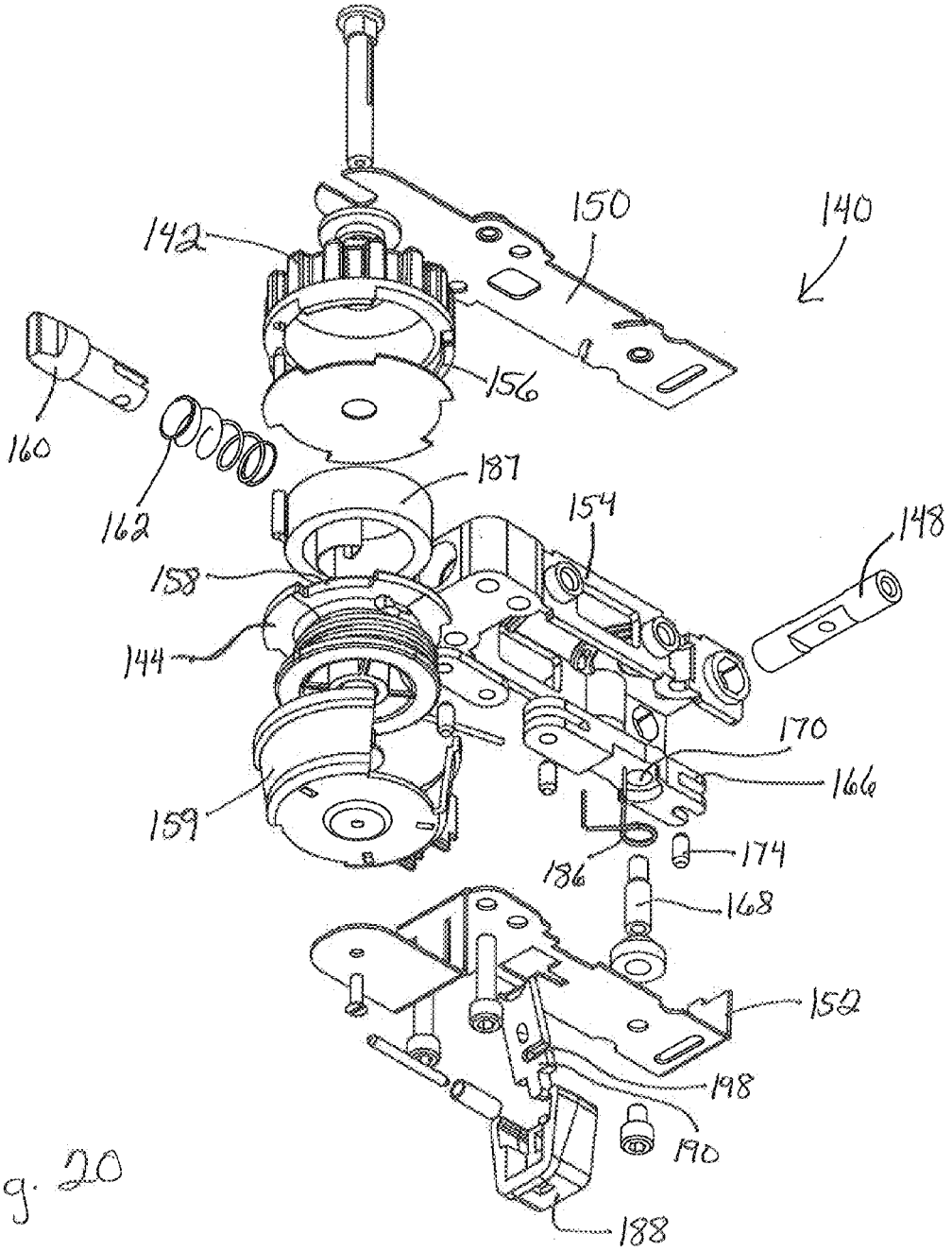
FIG. 20 is an exploded view of the stabilizing device of FIG. 13.
Figure 21:
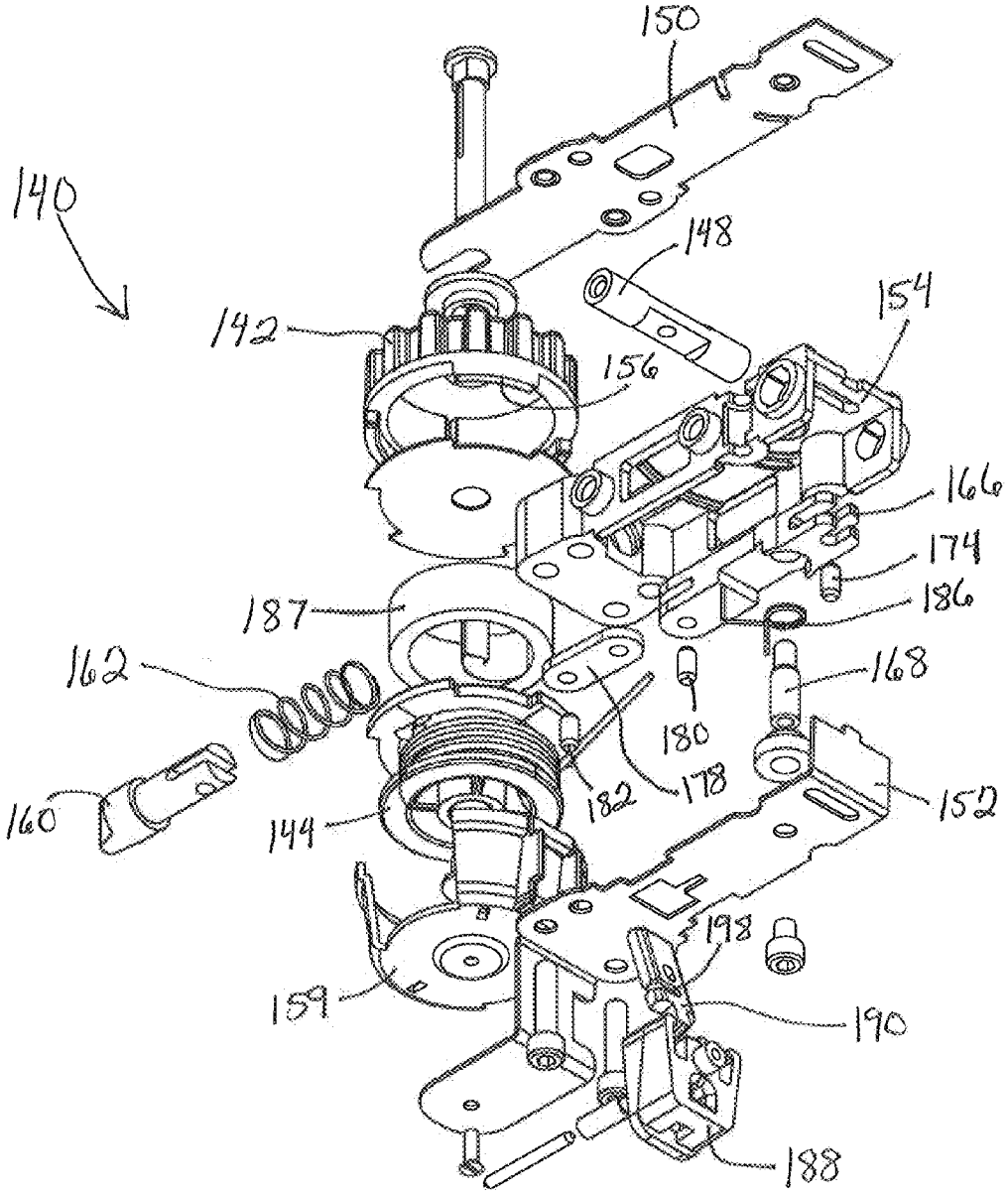
FIG. 21 is another exploded view of the stabilizing device of FIG. 13.

With reference to FIGS. 19-21, internal portion 140 of stabilizing device 110 may also include upper plate 150, lower plate 152, and internal housing 154. Spool 144 may be rotationally locked to gear 142 through the interaction of extensions 156 of gear 142 with recesses 158 in the front face of spool 144. Spool housing 159 may be disposed around spool 144 to maintain the position of anchor line 118 on spool 144. Lock member 160 may engage one of gear teeth 146 in order to prevent gear 142 and spool 144 from rotating and thereby preventing anchor line 118 from being released or retracted in the locked position. Spring 162 may be disposed around lock member 160 and may bias lock member 160 toward gear 142 through the interaction of spring 162 and inner surface 164 of internal housing 154. In this way, the default position of stabilizing device 110 may be a locked position. It should be understood that other embodiments of stabilizing device 110 may be configured with the default position being a released position. Upper plate 150 may be attached to an upper end of internal housing 154. Lower plate 152 may be attached to a lower end of internal housing 154 and a lower end of spool housing 159.

Guide arm 166 may be disposed within internal housing 154. Guide arm 166 may be pivotally disposed around arm axis member 168, which is disposed through aperture 170 in guide arm 166. First end 172 of guide arm 166 may be connected to activation member 148 with pin 174. Second end 176 of guide arm 166 may be connected to coupling link 178 with pin 180. Coupling link 178 may also be connected to lock member 160 with pin 182. Spring 186 may be disposed below guide arm 166 around arm axis member 168. Activation member 148 may be actuated by applying force to activation member 148. Guide arm 166 may be positioned parallel to internal housing 154 in the locked position. Actuation of activation member 148 may cause guide arm 166 to pivot about arm axis member 168. In other words, first end 172 of guide arm 166 is transferred in one horizontal direction and second end 176 of guide arm 166 is transferred in the opposite horizontal direction. This horizontal movement of second end 176 of guide arm 166 may pull lock member 160 away from gear 142, thereby allowing gear 142 and spool 144 to rotate and allow anchor line 118 to be released or retracted. In this way, actuation of activation member 148 may switch stabilizing device 110 from the default locked position into the released position. Once the force applied to activation member 148 is discontinued, spring 186 may cause arm axis member 168 to rotate thereby forcing guide arm 166 back into the parallel position of the locked position, which pushes lock member 160 into engagement with gear teeth 146. In this way, spring 186 biases guide arm 166 toward lock member 160.

Spool spring 187 may be operatively connected and rotationally locked to spool 144. Spool spring 187 may provide positive rotation of spool 144 in the released position. In other words, spool spring 187 continuously retracts anchor line 118 in the released position, unless an opposite force is applied to the distal end of anchor line 118.

Lower housing 188 may be attached to lower plate 152. Brake member 190 may be pivotally connected to lower housing 188 through pin 192. An upper end of brake member 190 may be disposed within internal housing 154. Specifically, shoulder 194 on the upper end of brake member 190 may engage distal end 196 of lock member 160. Anchor line 118 may be disposed through recess 198 of brake member 190. In the locked position shown in FIG. 19, brake member 190 is tilted relative to lower housing 188 such that recess 198 pinches anchor line 118, which further prevents release or retraction of anchor line 118 and also maintains tension on anchor line 118. As lock member 160 moves away from gear 142 when activation member 148 is actuated and guide arm 166 pivots, distal end 196 of lock member 160 may push shoulder 194 of brake member 190 such that brake member 190 is moved into a vertical position in which anchor line 118 may freely slide through recess 198 of brake member 190.

Referring again to FIG. 13, a user may actuate activation member 148 of stabilizing device 110 to switch stabilizing device 110 into the released position in order to pull the distal end of anchor line 118 and secure anchor attachment member to an anchor object as described above. The user may release activation member 148 in order to lock the length of anchor line 118 that is withdrawn from stabilizing device 110. After use, the user may again actuate activation member 148 in order to retract anchor line 118 into spool 144 within foregrip 120 of crossbow stock 112. It should be noted that stabilizing device 110 may be connected to a foregrip or other component in a base of a weapon, such as an archery bow, a rifle, or a shotgun.

In one embodiment, the stabilizing device is configured with the released position as the default position such that actuation of the activation member places the stabilizing device in the locked position in which the gear and spool member are prevented from rotating.

While preferred embodiments of the present invention have been described, it is to be understood that the embodiments are illustrative only and that the scope of the invention is to be defined solely by the appended claims when accorded a full range of equivalents, many variations and modifications naturally occurring to those skilled in the art from a review hereof.

The invention claimed is:

1. A weapon stabilizing device, comprising:

an anchor line operatively connected to a spool member, wherein rotation of the spool member releases and retracts the anchor line;

a lock member operatively associated with the spool member, wherein in a locked position the lock member prevents rotation of the spool member, wherein in a released position the lock member allows the spool member to rotate, wherein a default position of the lock member is the locked position or the released position, wherein the lock member is operatively associated with the spool member through a gear, wherein the gear is operatively connected to the spool member such that the spool member rotates with the gear, wherein the gear includes a plurality of gear teeth, and wherein a lock protrusion of the lock member engages one of the gear teeth to prevent the gear and the spool member from rotating in the locked position;

an activation member operatively associated with the lock member, wherein actuation of the activation member switches the lock member from the default position to an activated position, wherein the activated position is the locked position when the default position is the released position, and wherein the activated position is the released position when the default position is the locked position;

an attachment member operatively connected to the spool member, wherein the attachment member is configured for attachment to a base of a weapon for stabilizing the weapon during use; and a guide member operatively associated with the lock member and the activation member, wherein the guide member is configured to maintain the lock member in the default position, and wherein actuation of the activation member pivots the guide member relative to the lock member for transferring the lock member into the activated position.

2. The weapon stabilizing device of claim 1, further comprising a spool housing disposed around the spool.

3. The weapon stabilizing device of claim 1, further comprising an anchor attachment member operatively attached to a distal end of the anchor line.

4. The weapon stabilizing device of claim 1, further comprising a spool spring operatively associated with the spool member, wherein the spool spring rotatively biases the spool member.

5. The weapon stabilizing device of claim 1, further comprising a brake member configured to engage and maintain tension in the anchor line in the locked position.

6. The weapon stabilizing device of claim 1, further comprising a lock spring operatively associated with the lock member, the lock spring biasing the lock protrusion toward the gear teeth to set the locked position as the default position.

7. The weapon stabilizing device of claim 6, further comprising a guide spring biasing the guide member toward the lock member to maintain the lock member in the locked position when the activation member is not actuated.

8. The weapon stabilizing device of claim 1, further comprising a lock spring operatively associated with the lock member, the lock spring biasing the lock protrusion away from the gear teeth to set the released position as the default position.

9. The weapon stabilizing device of claim 8, further comprising a guide spring biasing the guide member away from the lock member to maintain the lock member in the released position when the activation member is not actuated.

10. The weapon stabilizing device of claim 1, wherein the spool member and the lock member are disposed within a housing, wherein the attachment member is operatively connected to the housing, and wherein the attachment member is configured to engage a Picatinny rail of the base of the weapon.

11. The weapon stabilizing device of claim 1, wherein the spool member and the lock member are disposed within a housing, wherein the attachment member is operatively connected to the housing, and wherein the attachment member includes one or more bolts or screws.

12. The weapon stabilizing device of claim 1, wherein the attachment member includes a foregrip configured for attachment to the base of the weapon.

13. The weapon stabilizing device of claim 1, wherein the activation member includes a flexible strap.

14. The weapon stabilizing device of claim 1, wherein the activation member includes a rigid member.

15. The weapon stabilizing device of claim 1, wherein the activation member includes a button mechanism.

16. A weapon comprising:

a base cavity in a base of the weapon;

a base plate configured to close the base cavity;

a spool member disposed within the base cavity;

an anchor line partially disposed within the base cavity and operatively connected to the spool member, wherein rotation of the spool member releases and retracts the anchor line from the base cavity;

a lock member disposed within the base cavity and operatively associated with the spool member, wherein in a locked position the lock member prevents rotation of the spool member, wherein in a released position the lock member allows the spool member to rotate, wherein a default position of the lock member is the locked position or the released position, wherein the lock member is operatively associated with the spool member through a gear, wherein the gear is operatively connected to the spool member such that the spool member rotates with the gear, wherein the gear includes a plurality of gear teeth, and wherein a lock protrusion of the lock member engages one of the gear teeth to prevent the gear and the spool member from rotating in the locked position;

an activation member partially disposed within the base cavity and operatively associated with the lock member, wherein actuation of the activation member switches the lock member from the default position to an activated position, wherein the activated position is the locked position when the default position is the released position, and wherein the activated position is the released position when the default position is the locked position; and a guide member operatively associated with the lock member and the activation member, wherein the guide member is configured to maintain the lock member in the default position, and wherein actuation of the activation member pivots the guide member relative to the lock member for transferring the lock member into the activated position;

wherein the weapon is configured to shoot an arrow, a bullet, or a shotgun shell.

17. The weapon of claim 16, wherein the base plate includes a foregrip of the weapon.

18. The weapon of claim 16, wherein the weapon comprises an archery bow, a crossbow, a rifle, a shotgun, or a pistol.

19. The weapon of claim 16, further comprising an anchor attachment member operatively attached to a distal end of the anchor line.

20. A method of stabilizing a weapon during use, comprising the steps of:

a) providing a weapon stabilizing device comprising: an anchor line operatively connected to a spool member, wherein rotation of the spool member releases and retracts the anchor line; a lock member operatively associated with the spool member, wherein in a locked position the lock member prevents rotation of the spool member, wherein in a released position the lock member allows the spool member to rotate, wherein a default position of the lock member is the locked position or the released position, wherein the lock member is operatively associated with the spool member through a gear, wherein the gear is operatively connected to the spool member such that the spool member rotates with the gear, wherein the gear includes a plurality of gear teeth, and wherein a lock protrusion of the lock member engages one of the gear teeth to prevent the gear and the spool member from rotating in the locked position; an activation member operatively associated with the lock member, wherein actuation of the activation member switches the lock member from a default position to an activated position; a guide member operatively associated with the lock member and the activation member, wherein the guide member is configured to maintain the lock member in the default position, and wherein actuation of the activation member pivots the guide member relative to the lock member for transferring the lock member into the activated position; and an attachment member operatively connected to the spool member;

b) connecting the attachment member to a base of a weapon, wherein the weapon is configured to shoot arrows, bullets, or shotgun shells;

c) pulling a distal end of the anchor line away from the spool member;

d) securing the distal end of the anchor line to an anchor object; and e) firing the weapon.

21. The method of claim 20, wherein the default position is a locked position in which the lock member prevents rotation of the spool member, wherein the activated position is a released position in which the lock member allows the spool member to rotate, and wherein step (c) further comprises: actuating the activation member to place the lock member in the released position and pulling the distal end of the anchor line away from the spool member.

22. The method of claim 21, wherein actuation of the activation member in step (c) causes the lock protrusion to disengage from the gear teeth to allow the gear and the spool member to rotate.

23. The method of claim 20, wherein the default position is a released position in which the lock member allows the spool member to rotate, wherein the activated position is a locked position in which the lock member prevents rotation of the spool member, and wherein step (e) further comprises: actuating the activation member to place the lock member in the locked position to prevent further release or retraction of the anchor line and firing the weapon.

24. The method of claim 23, wherein actuation of the activation member in step (e) causes the lock protrusion to engage one of the gear teeth to prevent the gear and the spool member from rotating.

25. The method of claim 20, wherein the weapon stabilizing device further includes an anchor attachment member operatively connected to the distal end of the anchor line, and wherein step (d) further comprises: securing the anchor attachment member to the anchor object.

26. The method of claim 20, wherein the anchor object includes a user's foot, a user's belt, a portion of a tree, or a tree stand.

27. The method of claim 20, wherein the weapon includes an archery bow, a crossbow, a rifle, a shotgun, or a pistol.

28. The method of claim 20, wherein step (b) further comprises connecting the attachment member to a Picatinny rail on the base of the weapon.

29. The method of claim 20, wherein step (b) further comprises connecting the attachment member to the base of the weapon with one or more bolts or screws.

30. The method of claim 20, wherein the attachment member includes a foregrip, and wherein step (b) further comprises connecting the foregrip to the base of the weapon so that the spool member and the lock member are disposed within the base of the weapon.

* * * * *